US007187298B2

(12) United States Patent
Gardner et al.

(10) Patent No.: US 7,187,298 B2
(45) Date of Patent: Mar. 6, 2007

(54) METHODS AND SYSTEMS FOR TRANSMITTING AND RECEIVING A DISCRETE MULTI-TONE MODULATED SIGNAL IN A FLUID

(75) Inventors: Wallace R. Gardner, Houston, TX (US); Vimal V. Shah, Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 191 days.

(21) Appl. No.: 11/035,107

(22) Filed: Jan. 13, 2005

(65) Prior Publication Data

US 2006/0164918 A1 Jul. 27, 2006

(51) Int. Cl.
*G01V 3/00* (2006.01)

(52) U.S. Cl. ..... 340/855.3; 340/856.3; 367/85; 370/464

(58) Field of Classification Search ..... 340/855.4, 340/856.3, 855.3; 166/250.01; 367/85; 370/464, 480
See application file for complete search history.

(56) References Cited

U.S. PATENT DOCUMENTS 5,586,084 A 12/1996 Barron et al.
6,002,643 A 12/1999 Tchakarov et al.
6,469,637 B1 10/2002 Seyler et al.
6,657,551 B2 12/2003 Huckaba et al.
6,880,634 B2 * 4/2005 Gardner et al. ..... 166/250.01
2002/0159333 A1 10/2002 Hahn et al.
2003/0151978 A1 8/2003 Jeffryes et al.
2004/0012500 A1 1/2004 Hahn et al.
2004/0156264 A1 8/2004 Gardner et al.

FOREIGN PATENT DOCUMENTS

WO WO2004/073240 A2 8/2004

OTHER PUBLICATIONS

Wallace R. Gardner; "Final Report: MWD Mud Pulse Telemetry System"; Gas Research Institute; Report GRI-02/0019.
Perry A. Fischer; "Real-time drill pipe telemetry: a step-change in drilling: high speed data transmission through the drill pipe has been a long-sought goal-it's finally nearing commercial use"; 4 pp.; World Oil, vol. 224, Issue 10; Oct. 1, 2003.

* cited by examiner

*Primary Examiner*—Albert K. Wong
(74) *Attorney, Agent, or Firm*—Mark E. Scott; Conley Rose, P.C.

(57) ABSTRACT

Methods and systems for transmitting and receiving a discrete multi-tone (DMT) modulated signal in a fluid. Some illustrative embodiments may be a method comprising transforming an input data series into an information-carrying signal (the information-carrying signal carrying input data from the input data series as modulations of at least one of a plurality of evenly spaced frequency bins), and applying the information-carrying signal to a transducer that converts the information-carrying signal into pressure variations within a fluid.

28 Claims, 13 Drawing Sheets

METHODS AND SYSTEMS FOR TRANSMITTING AND RECEIVING A DISCRETE MULTI-TONE MODULATED SIGNAL IN A FLUID

BACKGROUND

1. Technical Field

The present subject matter relates to transmitting and receiving telemetry. More particularly, the subject matter relates to transmitting and receiving a discrete multi-tone modulated telemetry signal propagated in a fluid.

2. Background Information

Modern petroleum drilling and production operations demand a great quantity of information relating to parameters and conditions downhole. Such information typically includes characteristics of the earth formations traversed by the wellbore, along with data relating to the size and configuration of the borehole itself. The collection of information relating to conditions downhole is referred to as "logging."

Logging frequently is done during the drilling process, eliminating the necessity of removing or "tripping" the drilling assembly to insert a wireline logging tool to collect the data. Data collection during drilling also allows the driller to make accurate modifications or corrections as needed to optimize performance while minimizing down time. Designs for measuring conditions downhole, including the movement and location of the drilling assembly contemporaneously with the drilling of the well, have come to be known as "measurement-while-drilling" techniques, or "MWD". Similar techniques, concentrating more on the measurement of formation parameters, commonly have been referred to as "logging while drilling" techniques, or "LWD". While distinctions between MWD and LWD may exist, the terms MWD and LWD often are used interchangeably. For purposes of this disclosure, the term LWD will be used with the understanding that this term encompasses both the collection of formation parameters and the collection of information relating to the movement and position of the drilling assembly.

Sensors or transducers are located within "tools" at the lower end of the drillstring in LWD systems. In particular, sensors employed in LWD applications are positioned in a cylindrical drill collar that is positioned close to the drill bit. While drilling is in progress these sensors continuously or intermittently monitor predetermined drilling parameters and formation data, and the tools transmit the information to a surface detector by some form of telemetry. There are a number of communication schemes in the related art that transmit information regarding downhole parameters to the surface, such as mud pulse telemetry systems.

Mud pulse telemetry systems create pressure pulses in the drilling fluid within the drillstring. The information that is acquired by the downhole sensors is transmitted by suitably timing pressure pulses in the drilling fluid. The information is received and decoded by a pressure transducer and computer at the surface. Data transmission rates achievable through mud pulse systems have generally been limited to around 1 Hz, restricting the amount of information that can be transmitted real-time as drilling is taking place. Accordingly, a downhole telemetry system capable of higher data rates is desirable.

SUMMARY OF SOME OF THE EMBODIMENTS

The problems noted above are addressed in large part by methods and systems for transmitting and receiving a discrete multi-tone (DMT) modulated signal in a fluid. Some illustrative embodiments may be a method comprising transforming an input data series into an information-carrying signal (the information-carrying signal carrying input data from the input data series as modulations of at least one of a plurality of evenly spaced frequency bins), and applying the information-carrying signal to a transducer that converts the information-carrying signal into pressure variations within a fluid.

Other illustrative embodiments may be a method comprising detecting pressure variations propagated through a fluid, converting detected pressure variations into an information-carrying signal, and extracting an output data series from the information-carrying signal (the information-carrying signal carrying output data from the output data series as modulations of at least one of a plurality of evenly spaced frequency bins).

Yet further illustrative embodiments may be a telemetry system comprising a downhole tool comprising a sensor that generates downhole data, a subsurface telemetry transmitter coupled to the downhole tool (the subsurface telemetry transmitter generates a first pressure-modulated signal in a fluid that comprises a plurality of evenly spaced frequency bins), and a surface telemetry receiver that detects the first pressure-modulated signal and regenerates the downhole data collected by the downhole tool. The downhole data modulates at least one of the plurality of evenly spaced frequency bins.

Yet further illustrative embodiments may be a subsurface telemetry transmitter comprising a fluid modulation valve, and servo control logic coupled to the fluid modulation valve (the servo control logic causes the fluid modulation valve to generate discrete multi-tone (DMT) modulated pressure waves in a fluid). Collected subsurface data is used to modulate sub-channel carriers within a DMT modulated information-carrying signal. The information-carrying signal is used by the servo control logic to actuate the fluid modulation valve.

Yet further illustrative embodiments may be a subsurface telemetry transmitter comprising a fluid modulation valve, and servo control logic coupled to the fluid modulation valve (the servo control logic causes the fluid modulation valve to generate discrete multi-tone (DMT) modulated pressure waves in a fluid). Collected subsurface data modulates an information-carrying signal using DMT modulation. The information-carrying signal is used by the servo control logic to actuate the fluid modulation valve.

Yet further illustrative embodiments may be a surface telemetry receiver comprising a pressure sensor that generates an information-carrying signal, and sensor signal processing logic coupled to the pressure sensor. Variations in the information-carrying signal correspond to pressure variations in a fluid that are detected by the pressure sensor. The sensor signal processing logic demodulates the information-carrying signal using discrete multi-tone (DMT) demodulation and recovers subsurface data encoded in the information-carrying signal.

Yet further illustrative embodiments may be a bottom hole assembly comprising a downhole tool comprising a downhole sensor that generates downhole data, and a mud modulator coupled to the downhole tool and configured to couple to a drillstring. The mud modulator generates a discrete multi-tone (DMT) modulated pressure signal propagated in drilling fluid within the drillstring (the DMT modulated pressure signal comprising the downhole data).

BRIEF DESCRIPTION OF THE DRAWINGS

For a detailed description of embodiments of the invention, reference will now be made to the accompanying drawings in which.

NOTATION AND NOMENCLATURE

Certain terms are used throughout the following discussion and claims to refer to particular system components. This document does not intend to distinguish between components that differ in name but not function.

In the following discussion and in the claims, the terms "including" and "comprising" are used in an open-ended fashion, and thus should be interpreted to mean "including but not limited to . . . " Also, the term "couple" or "couples" is intended to mean either an indirect or direct connection. Thus, if a first device couples to a second device, that connection may be through a direct connection, or through an indirect connection via other devices and connections. The term "system" refers to a collection of two or more parts and may be used to refer to a telemetry system or a portion of a telemetry system. The term "software" includes any executable code capable of running on a processor, regardless of the media used to store the software. Thus, code stored in non-volatile memory, and sometimes referred to as "embedded firmware," is included within the definition of software.

The term "fluid" is intended to mean all fluid mediums, including liquids and gases. The terms "upstream" and "downstream" refer, in the context of this disclosure, to the transmission of information from subsurface equipment to surface equipment, and from surface equipment to subsurface equipment, respectively. The terms "surface," "subsurface" and "downhole" are relative terms. The fact that a particular piece of hardware is described as being on the surface does not necessarily mean it must be physically above the surface of the Earth; but rather, describes only the relative placement of the surface, subsurface and downhole pieces of equipment.

The term "noise," as used in this disclosure, is meant to indicate a signal that is largely unrelated to the desired information and interferes with the reception or decoding of a signal comprising desired information. Thus, even though an interfering signal may not be random or spurious in nature, and may in fact contain coherent information, the interfering signal is considered noise if the signal is not the desired signal or information, and it interferes with the desired signal or with decoding of the desired information.

DETAILED DESCRIPTION OF THE EMBODIMENTS

Figure 1:
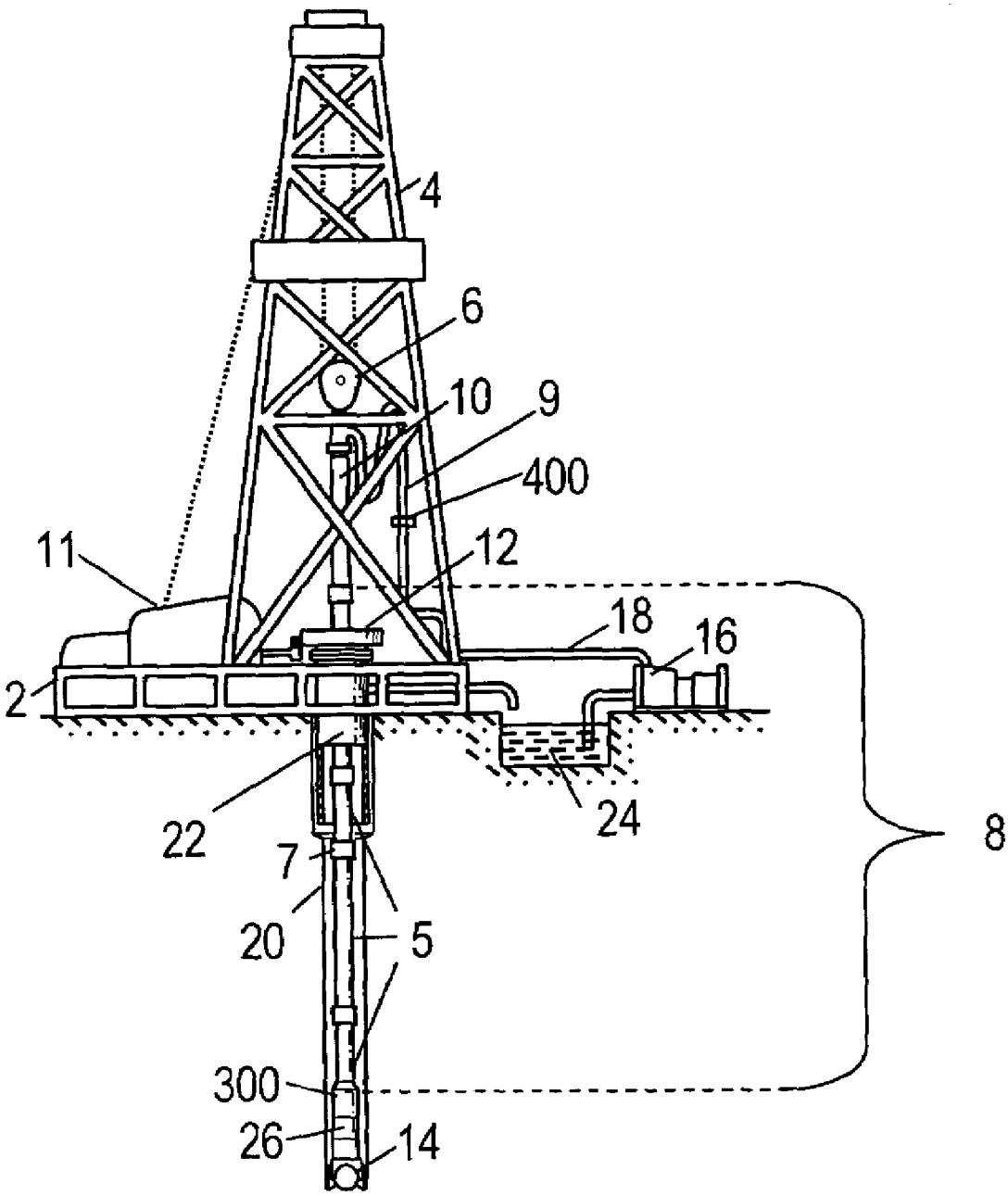
FIG. 1 is a schematic view of a petroleum well in which a discrete multi-tone (DMT) fluid modulation telemetry system, constructed in accordance with at least some embodiments, may be employed.

Turning now to the figures, FIG. 1 shows a hydrocarbon well during drilling operations. A drilling platform 2 is equipped with a derrick 4 that supports a hoist 6. Drilling of oil and gas wells is carried out by a string of drill pipes 5 connected together by "tool" joints 7 so as to form a drillstring 8. The hoist 6 suspends a kelly 10, and the hoist 6 is used to lower the drillstring 8 through rotary table 12. Rotating table motor 11 may rotate rotary table 12 from the side as shown in FIG. 1. Connected to the lower end of the drillstring 8 is a drill bit 14. The bit 14 is rotated and drilling accomplished by rotating the drillstring 8, by use of a downhole motor near the drill bit (not shown), or by both methods.

Drilling fluid, sometimes termed mud, is pumped by mud recirculation equipment 16 through supply pipe 18, through standpipe 9, through drilling kelly 10, and down through the drillstring 8 at high pressures and volumes (e.g., 3000 p.s.i. at flow rates of up to 1400 gallons per minute) to emerge through nozzles or jets in the drill bit 14. The drilling fluid then travels back up the hole via the annulus formed between the exterior of the drillstring 8 and the borehole wall 20, through the blowout preventer 22, and into a mud pit 24 on the surface. On the surface, the drilling fluid is cleaned and then recirculated by recirculation equipment 16. The drilling fluid is used to cool the drill bit 14, to carry cuttings from the base of the bore to the surface, and to balance the hydrostatic pressure in the rock formations. The drilling fluid within the drillstring may also be used as a medium for transmitting telemetry from downhole to the surface.

Figure 2:
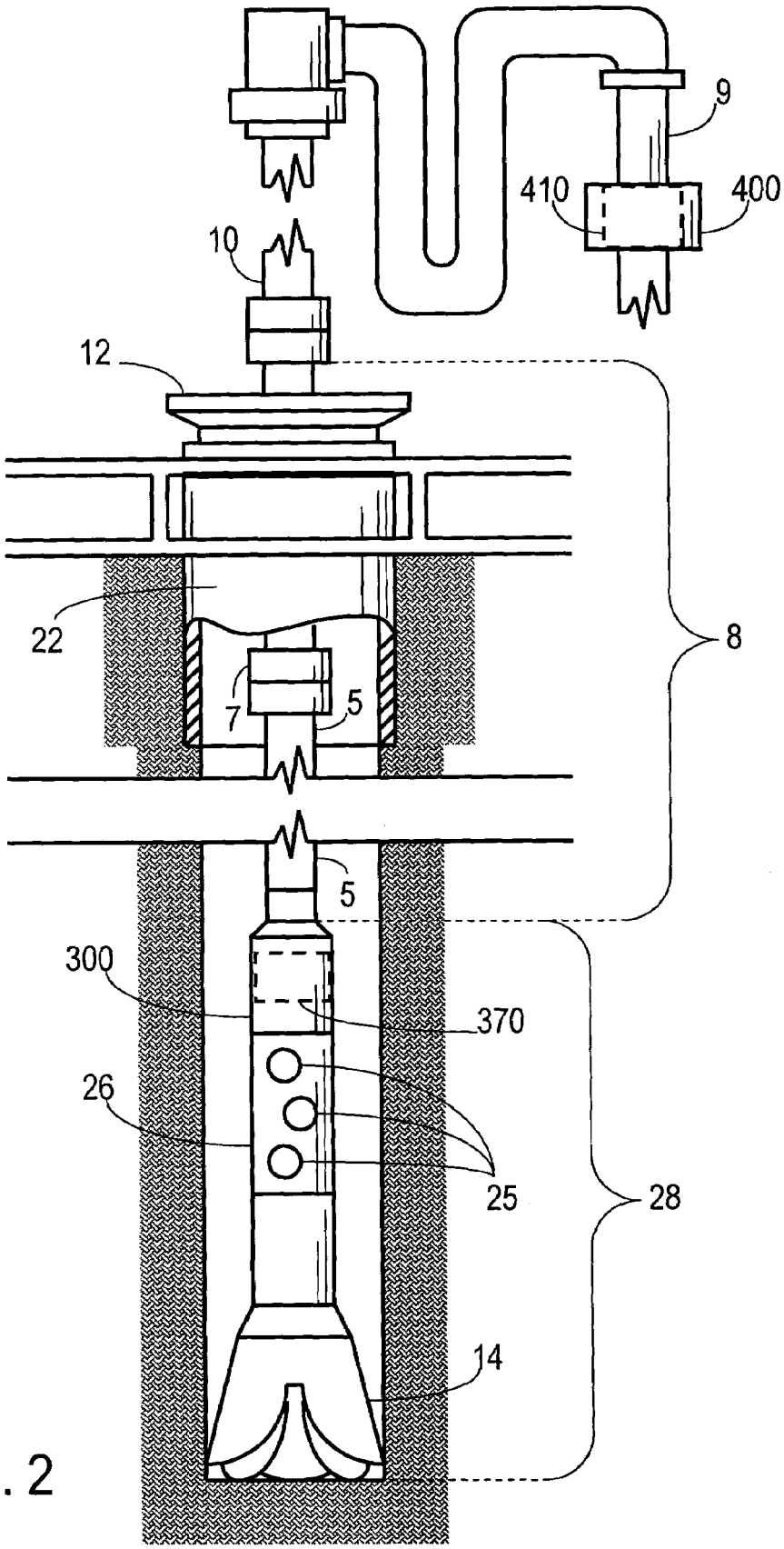
FIG. 2 illustrates the locations where both a transmitter and a receiver in a DMT fluid modulation telemetry system may be located on a drillstring, in accordance with at least some embodiments.

Downhole tool 26 couples to a telemetry transmitter 300 that transmits telemetry (e.g., information-carrying) signals in the form of pressure variations within the fluid flowing through the inside of the drillstring 8. A telemetry receiver 400 is coupled to the standpipe 9 and receives transmitted telemetry signals. FIG. 2 shows a more detailed view of the location of the telemetry transmitter 300 and the telemetry receiver 400 on a drillstring as part of a fluid modulation telemetry system constructed in accordance with at least some embodiments. The telemetry transmitter 300 may be located within the bottom hole assembly 28, where it couples to downhole sensors 25. Downhole sensors 25, housed within downhole tool 26, may provide telemetry transmitter 300 with information to embed within a transmission. Telemetry transmitter 300 comprises fluid modulator 370, which generates pressure modulations that propagate up the drillstring 8 to the surface where telemetry receiver 400 detects them. Telemetry receiver 400 may be mounted on standpipe 9, and comprises fluid modulation detector 410, which senses the pressure modulations generated by fluid modulator 370 of the telemetry transmitter 300. The fluid modulation detector 410 converts the pressure modulations into electrical signals, which may then be demodulated by the telemetry receiver 400.

Figure 3A:
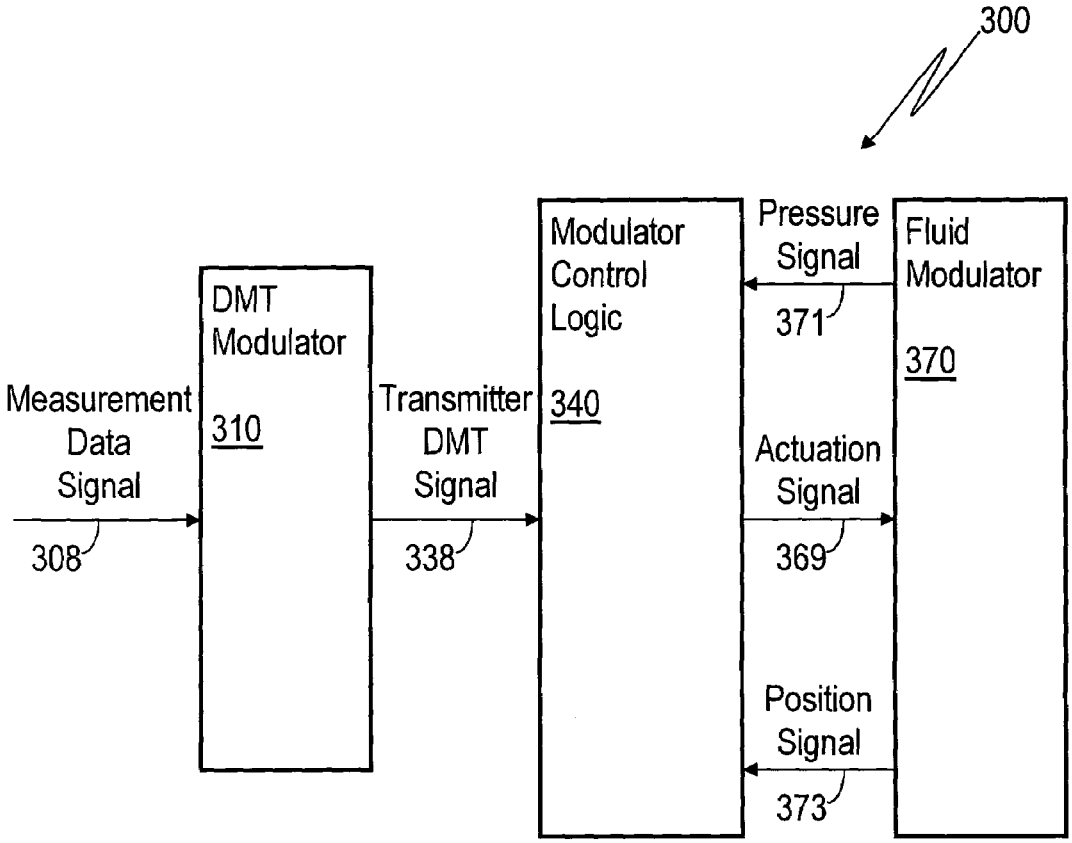
FIG. 3A illustrates an electrical block diagram of a DMT fluid modulation telemetry transmitter constructed in accordance with at least some embodiments.

FIG. 3A illustrates an electrical block diagram of telemetry transmitter 300 constructed in accordance with at least some embodiments. Telemetry transmitter 300 comprises discrete multi-tone (DMT) modulator 310, which couples to modulator servo control logic 340. DMT modulator 310 receives measurement data signal 308 generated by downhole sensors 25 (FIG. 2). Although measurement data signal 308 is expressed as a digital signal in the embodiments herein described, in alternative embodiments measurement data signal 308 may be expressed as an analog signal. DMT modulator 310 modulates a plurality of carrier signals (generated within DMT modulator 310) with measurement data signal 308, using discrete multi-tone modulation to produce transmitter DMT signal 338. The transmitter DMT signal 338 thus produced is used as the input signal to modulator servo control logic 340, which couples to fluid modulator 370.

The modulator servo control logic 340 generates actuation signal 369, used to actuate the fluid modulator 370 and generate the discrete multi-tone signal propagated up the drillstring 8 through the drilling fluid. The actuation signal 369 is generated based on the transmitter DMT signal 338, and adjusted based on a feedback signal provided by the fluid modulator 370 (e.g., pressure signal 371 and position signal 373). The feedback signal allows the fluid modulator 370 to be controlled using a closed-loop control configuration. This improves the overall response of the fluid modulator 370 (as compared to an open-loop control configuration), increasing the speed at which the fluid modulator 370 may be operated, and decreasing the degree of variation in the magnitude of the pressure pulse induced by the fluid modulator 370, given a particular level of the actuation signal 369. In alternative embodiments where the fluid modulator 370 has substantially linear control characteristics, open-loop control may be used.

Figure 3B:
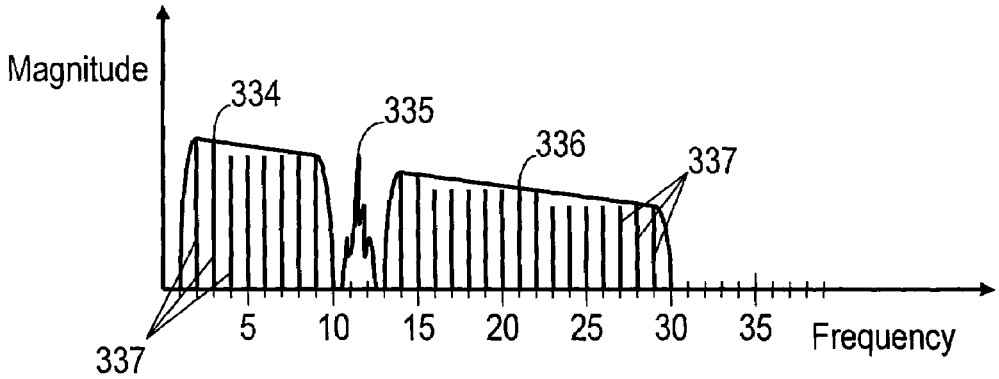
FIG. 3B illustrates a band distribution of a DMT telemetry signal.

As already noted, transmitter DMT signal 338 comprises a plurality of individual modulated carriers, each of which may be modulated using a variety of modulation techniques (e.g., 2-bit quadrature phase-shift keying modulation, 4-bit quadrature amplitude modulation, and 6-bit quadrature amplitude modulation). The modulation technique used with a particular carrier may depend on the type and amount of noise at or near the frequency of the carrier. These modulated carriers are distributed over the available bandwidth as shown in FIG. 3B, and are sometimes referred to as "subcarriers" or "frequency bins".

As illustrated, more than one band may be defined, each comprising one or more frequency bins 337. Multiple bands (e.g. bands 334 and 336) may be defined to avoid frequencies where noise is present (e.g., noise 335) or in order to support full duplex communications. Where full duplex communication is implemented, one or more bands may be dedicated to downstream communications (e.g., band 334), while other bands may be dedicated to upstream communications (e.g., band 336). Full duplex communications may be achieved through the use of discrete multi-tone fluid modulation transmitters and receivers both downhole and at the surface, allowing simultaneous transmission and reception of telemetry both upstream and downstream. Although the embodiments described in the present disclosure illustrate only upstream transmission and reception of telemetry so as not to unduly complicate the disclosure, it is intended that both upstream and downstream telemetry transmission and reception be encompassed by the present disclosure.

Figure 3C:
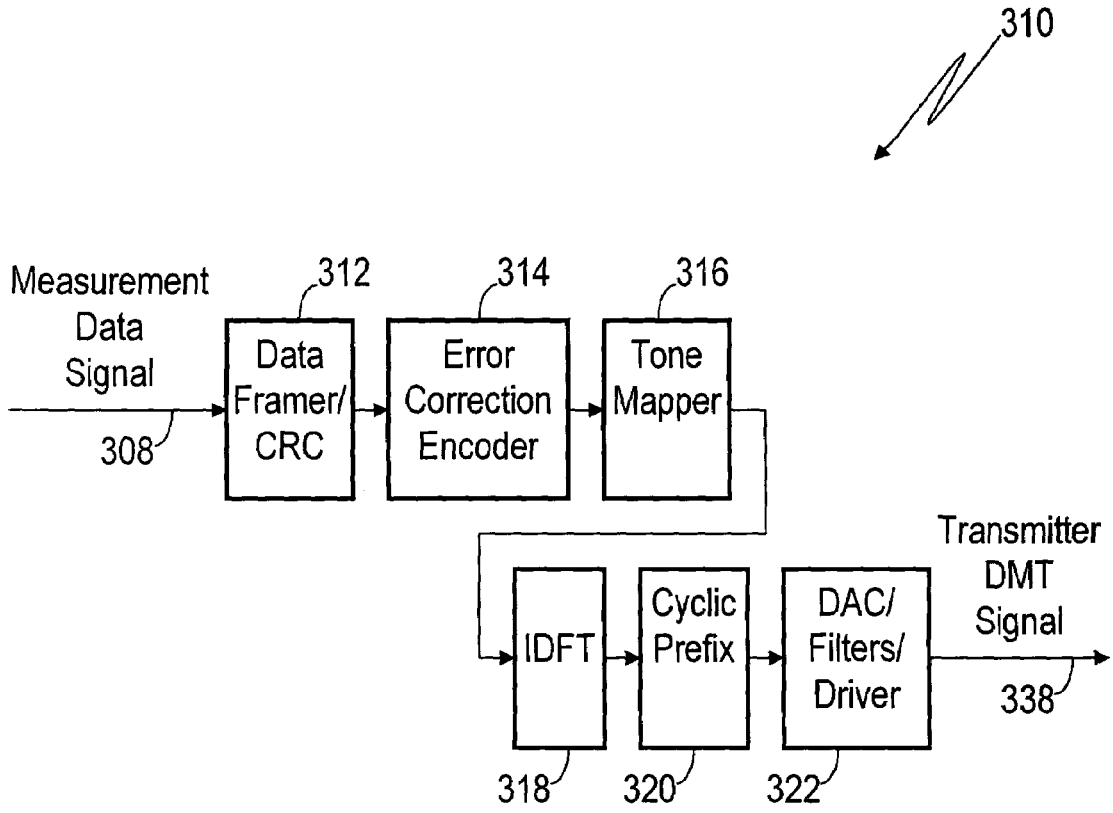
FIG. 3C illustrates a software block diagram of logic that drives a DMT fluid modulator.

FIG. 3C illustrates an electrical block diagram of DMT modulator 310 in greater detail. DMT modulator 310 comprises data framer/cyclic redundancy code (CRC) block 312, error encoder 314, tone mapper 316, inverse discrete Fourier transform (IFDT) block 318, cyclic prefix block 320, and digital-to-analog converter (DAC)/Filters/Driver block 322. Data framer/CRC block 312 receives measurement data signal 308 and groups bytes of data together to form data frames. The data frames are then grouped together with a synchronization frame and a cyclic redundancy code, calculated from the contents of the data frames. The cyclic redundancy code provides one mechanism to detect errors in data received by the telemetry receiver 400. Data framer/CRC block 312 couples to error correction encoder 314, providing the error correction encoder 314 with framed and CRC wrapped data. Error correction encoder 314 processes the data frames to add redundancy to the data stream. A Reed-Solomon code is suitable, but other error correction codes may be equivalently used.

Error correction encoder 314 couples to tone mapper 316, which takes bits from the data stream generated by error correction encoder 314 and assigns them to frequency bins, sometimes referred to as sub-channels. For each frequency bin, the bits are used to determine a Discrete Fourier Transform coefficient that specifies a frequency amplitude. The number of bits assigned to each frequency bin by the tone mapper 316 may vary (i.e., the number may be different for each bin, and the number for each bin may change over time), and the number may depend on the estimated error rate for each frequency bin.

Tone mapper 316 couples to IFDT block 318, with the tone mapper 316 providing the coefficients that are processed by IFDT block 318. The IFDT block 318 generates a time-domain signal carrying the desired information at each frequency. IFDT block 318 couples to cyclic prefix block 320, and the cyclic prefix block 320 duplicates the end portion of the time-domain signal generated by IFDT block 318 and prepends it to the beginning of the time-domain signal. This permits later frequency domain equalization of the signal at the telemetry receiver 400 (as described below). Cyclic prefix block 320 couples to DAC/filters/driver block 322, which transforms the signal-with-prefix generated by cyclic prefix block 320 into analog form, and then filters and amplifies the analog signal, producing transmitter discrete multi-tone signal 338. The DMT modulator 310 may be implemented in software, hardware, or a combination of the two, and the present disclosure is intended to encompass all such embodiments.

Figure 3D:
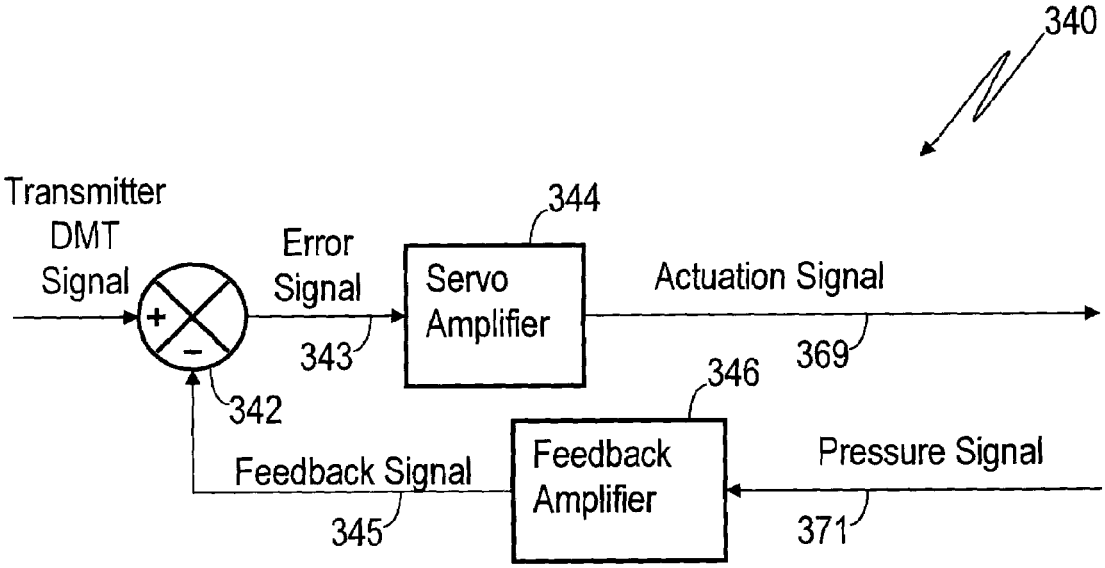
FIG. 3D illustrates an electrical block diagram of fluid modulator servo control logic using pressure feedback and constructed in accordance with at least some embodiments.

FIG. 3D illustrates an electrical block diagram of modulator servo control logic 340, constructed in accordance with at least some embodiments. Transmitter DMT signal 338 drives modulator servo control logic 340, providing one of two input signals to summation node 342. Summation node 342 is also coupled to feedback amplifier 346 by feedback signal 345, which provides the second of the two input signals to summation node 342. Summation node 342 adds transmitter DMT signal 338 with the negative of the feedback signal 345 to produce error signal 343 at the output of summation node 342. Summation node 342 is coupled by error signal 343 to servo amplifier 344, which generates actuation signal 369. Actuation signal 369, in response to error signal 343, drives actuators that control fluid modulator 370 (FIG. 3A).

Figure 3E:
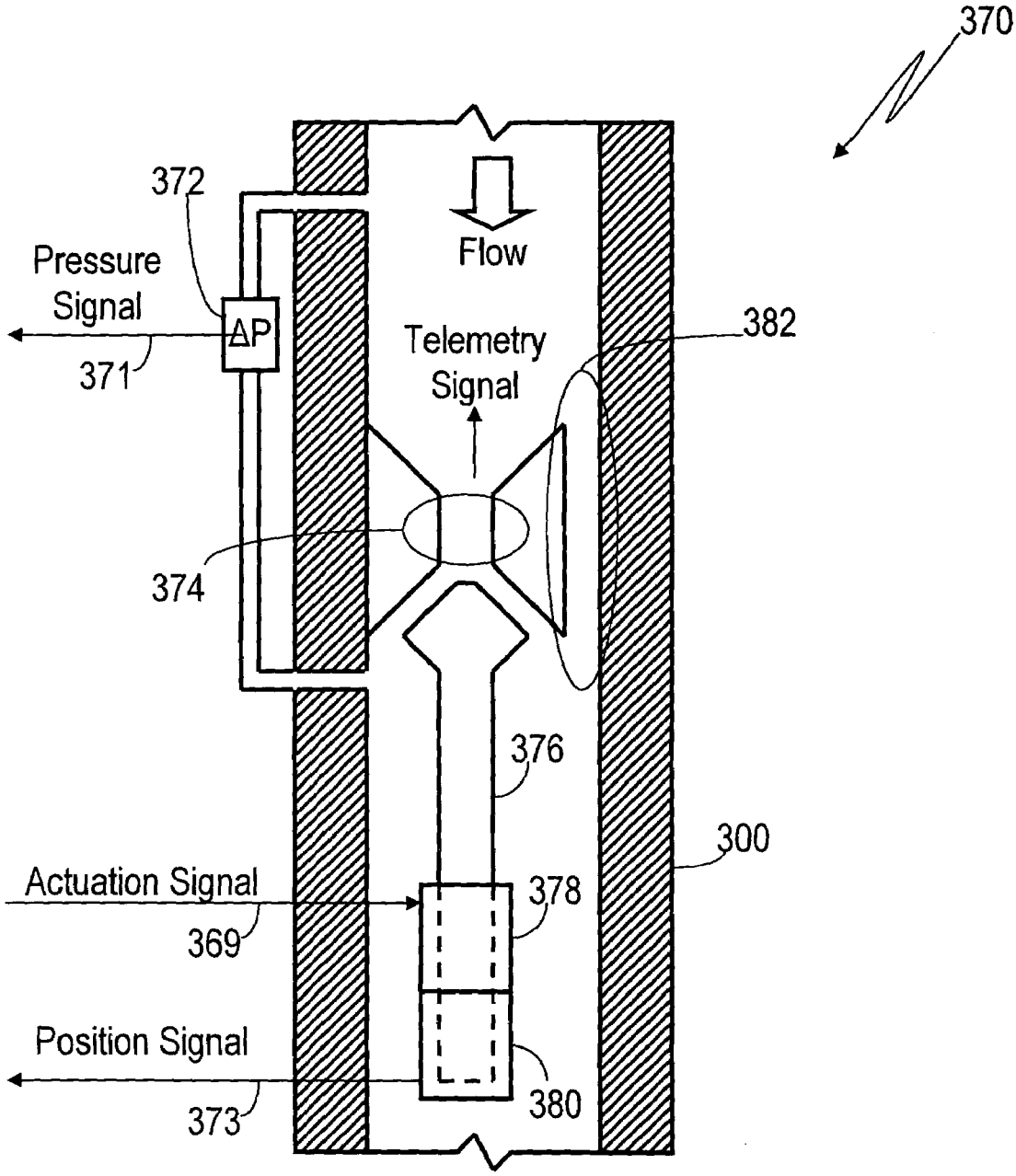
FIG. 3E illustrates a fluid modulator constructed in accordance with at least some embodiments.

FIG. 3E illustrates fluid modulator 370 constructed in accordance with at least some embodiments. The fluid modulator 370 comprises moveable member 376, orifice 374, actuator 378, position sensor 380, differential pressure sensor 372, and bypass port 382. The fluid modulator 370 is positioned in the drilling fluid flow. Moveable member 376 couples to actuator 378 and position sensor 380. Actuation signal 369 drives actuator 378, modulating moveable member 376 and creating pressure fluctuations in the fluid that travel back up the drillstring (against the direction of flow as shown). A bypass port 382 allows a controlled flow of fluid to bypass the movable member and orifice, and prevents the total interruption of the flow. The bypass port 382 thus helps to more precisely control the pressure of the drilling fluid by establishing a relatively fixed pressure range within which the fluid modulator 370 operates. In alternative embodiments the bypass port 382 may comprise an adjustable valve (not shown) that may be calibrated to limit the pressure variations to a desired range.

The fluid modulator 370 also comprises several sensors capable of generating signals that may be used by a closed-loop control circuit such as modulator servo control logic 340 (not shown in FIG. 3E). Differential pressure sensor 372 is configured so as to sense a difference in pressure of the drilling fluid across the orifice 374. The differential pressure sensor 372 thus generates pressure signal 371, and as shown in FIG. 3D, this signal may be used as closed-loop control feedback by modulator servo control logic 340. Signals reflecting other monitored parameters (e.g., position signal 373 generated by positions sensor 380 as shown in FIG. 3E) may equivalently be used.

Continuing to refer to FIG. 3E, fluid modulator 370 induces the complex pressure waveform of a discrete multi-tone telemetry signal in the drilling fluid flowing through the drillstring 8. The actuator 378 may be configured to selectively position the moveable member 376 in response to actuation signal 369, which may be a discrete multi-tone telemetry signal. The actuator 378 may change the position of the moveable member 376 by discrete increments in response to variations in the amplitude of the actuation signal 369. This may be accomplished by enabling individual hydraulic valves (not shown), each hydraulically varying the position of moveable member 376 by a fixed increment as the actuation signal 369 increases above or falls below predetermined signal level thresholds. In other embodiments, the control signal may control a motor operated pressure control valve (not shown), with the pressure provided by the pressure control valve being proportional to the amplitude of the actuation signal 369. The pressure control valve in turn hydraulically positions the moveable member 376 and thus generates pressure variations in the drilling fluid proportional to the variations in the actuation signal 369.

In yet other embodiments, the moveable member 376 may be manufactured using a magnetostrictive material. The actuation signal 369 is applied as a magnetic field (e.g., using an induction coil) that causes the moveable member to expand or contract and correspondingly vary the pressure differential across the orifice 374. In yet other embodiments, the moveable member 376 may be manufactured using a piezoelectric material. The moveable member 376 may be made to expand or contract by the application of an electric field to the moveable member 376, again causing differential pressure variations across the orifice 374 that are proportional to the applied actuation signal 369. The degree of expansion or contraction of the various embodiments of the moveable member 376 described may be measured by position sensor 380.

Figure 4A:
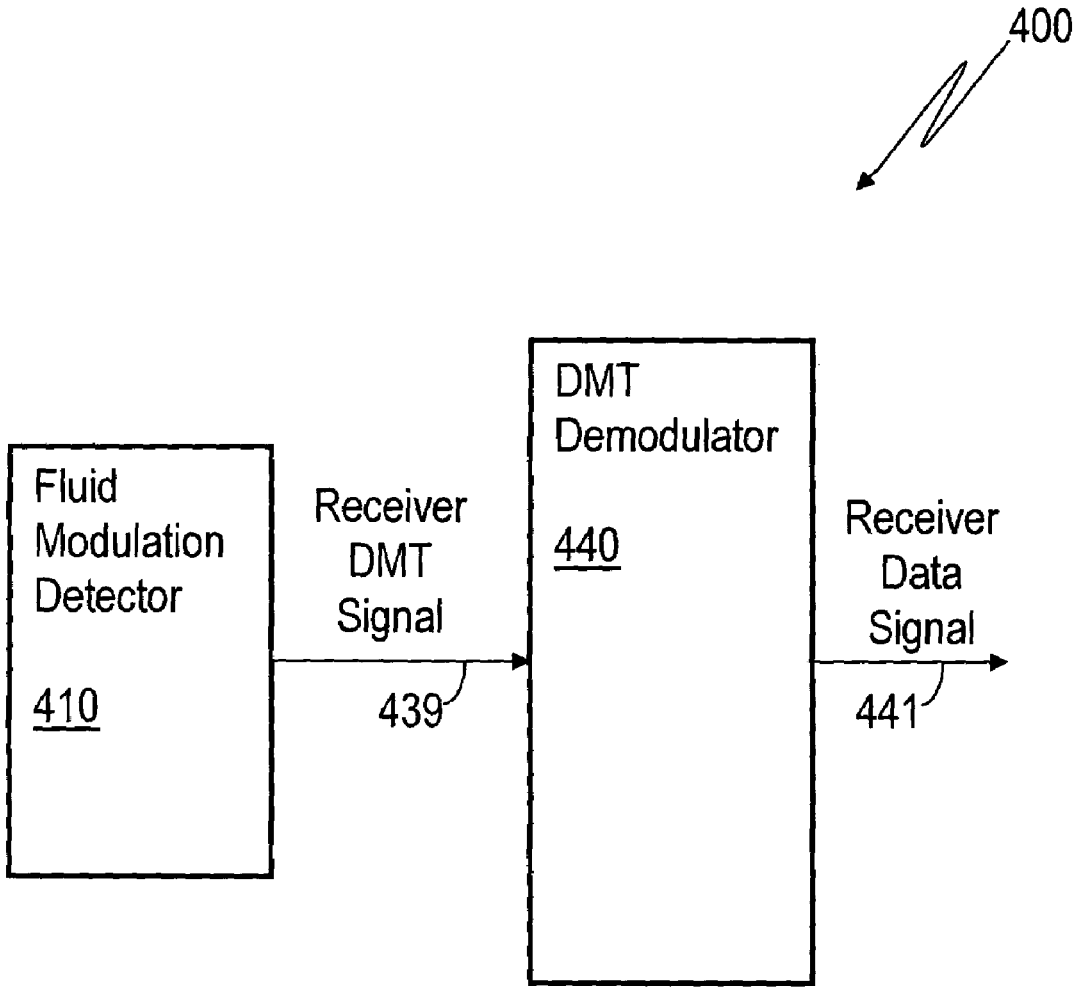
FIG. 4A illustrates an electrical block diagram of a DMT fluid modulation telemetry receiver constructed in accordance with at least some embodiments.

The discrete multi-tone modulated pressure variations generated by the fluid modulator 370 are propagated up the drillstring 8 against the direction of drilling fluid flow, and eventually reach the telemetry receiver 400. FIG. 4A illustrates a telemetry receiver 400, constructed in accordance with at least some embodiments, comprising fluid modulation detector 410 and DMT demodulator 440. Receiver DMT signal 439 couples fluid modulation detector 410 to DMT demodulator 440. DMT demodulator 440 in turn generates receiver data signal 441. The telemetry receiver 400 may then be coupled by the receiver data signal 441 to any number of computer systems (not shown), allowing processing and analysis of recovered downhole measurement data.

Figure 4B:
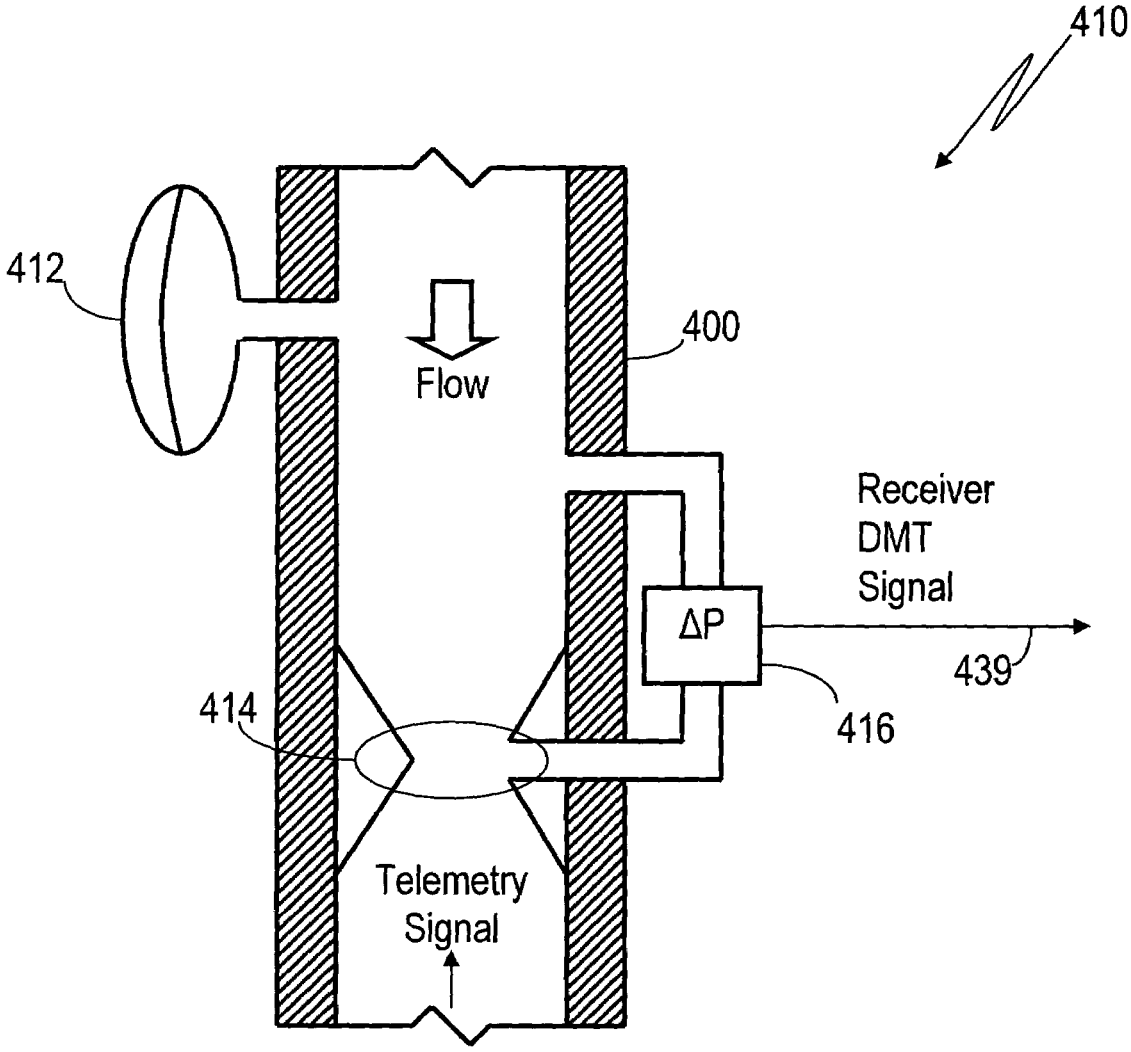
FIG. 4B illustrates a fluid modulation detector assembly comprising an inline venturi pressure sensor and constructed in accordance with at least some embodiments.
Figure 4C:
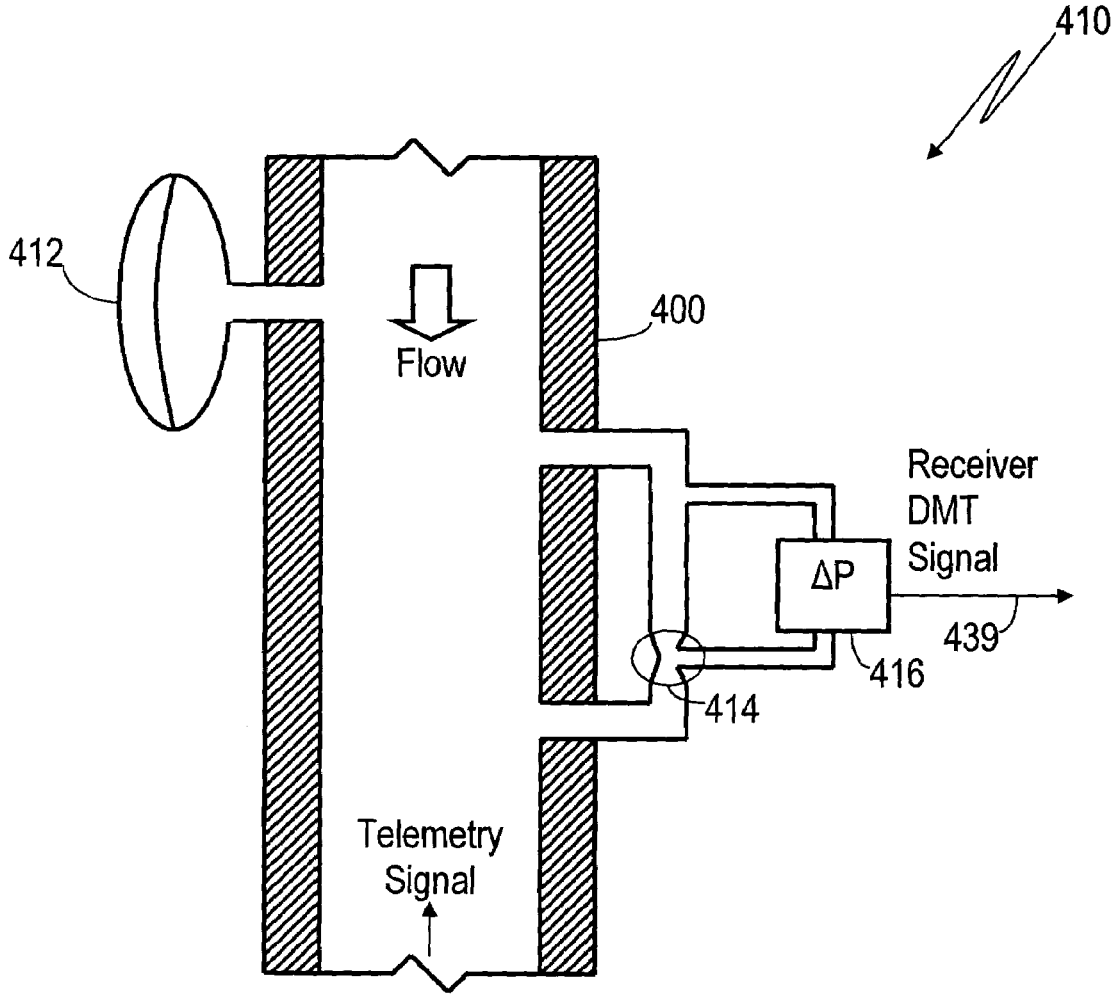
FIG. 4C illustrates a fluid modulation detector assembly comprising a bypass venturi pressure sensor and constructed in accordance with at least some embodiments.
Figure 4D:
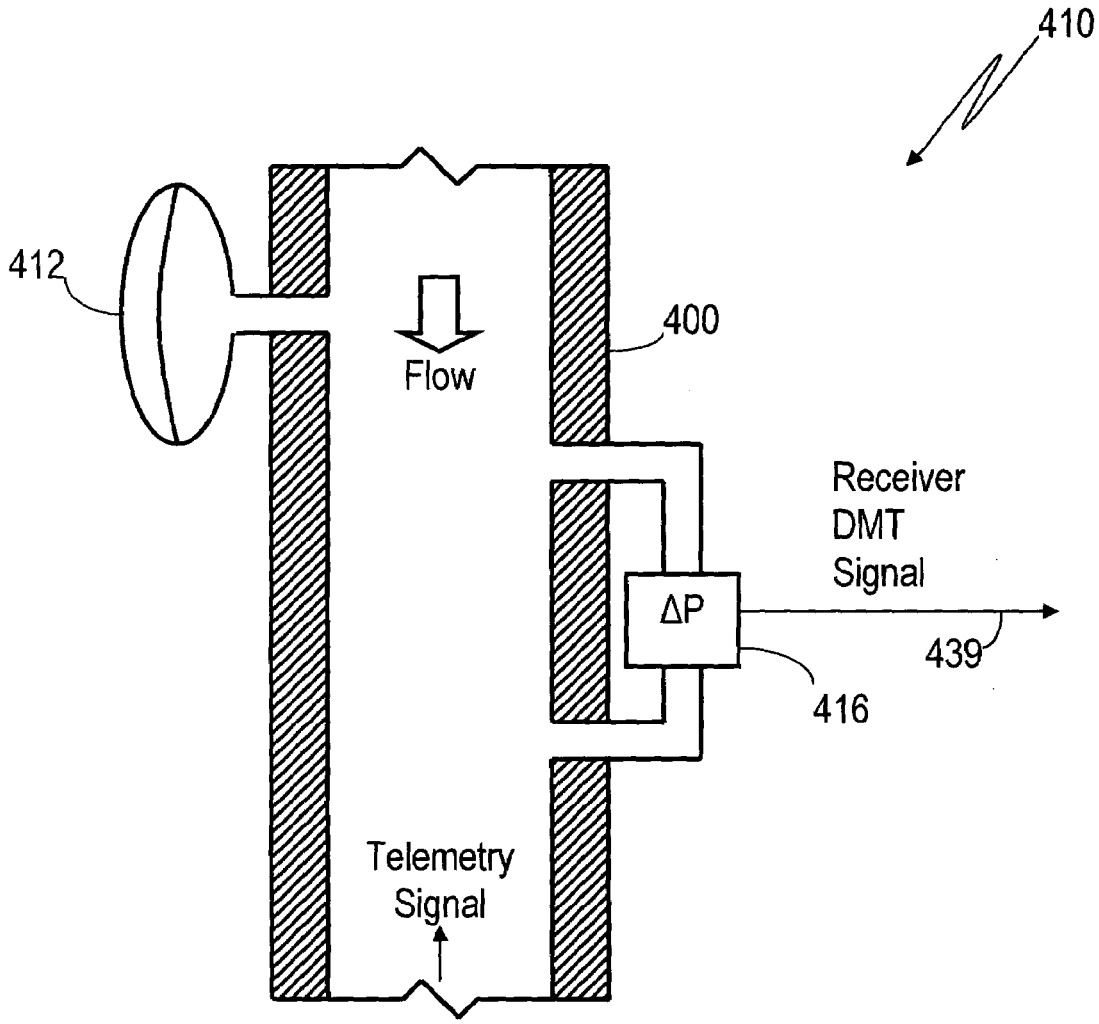
FIG. 4D illustrates a fluid modulation detector assembly comprising a differential pressure sensor and constructed in accordance with at least some embodiments.
Figure 4E:
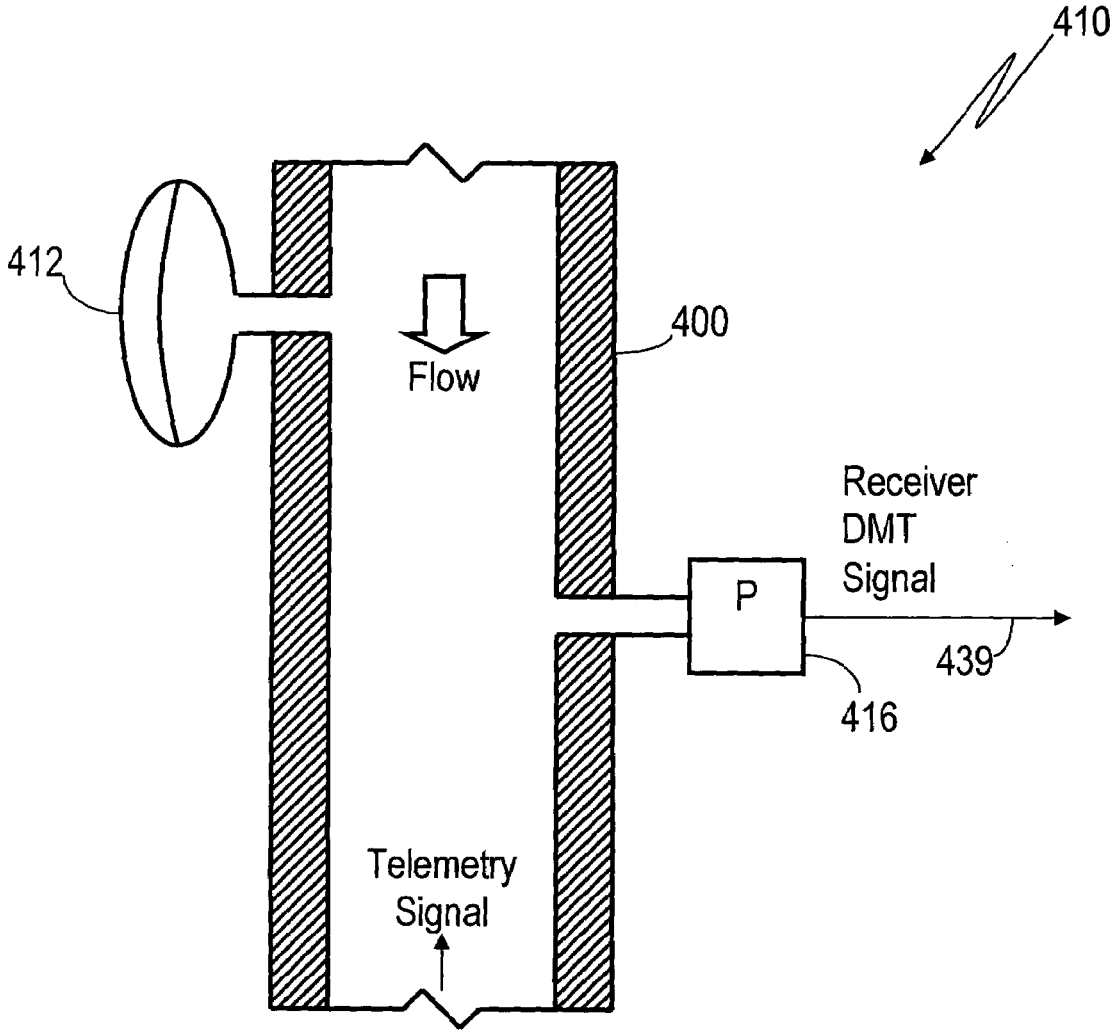
FIG. 4E illustrates a fluid modulation detector assembly comprising a standard standpipe pressure sensor and constructed in accordance with at least some embodiments.

FIG. 4B illustrates a fluid modulation detector 410 constructed in accordance with at least some embodiments. The fluid modulation detector 410 comprises a venturi 414, a pressure sensor 416, and a desurger 412. One side of the pressure sensor 416 couples to the venturi 414, and the other side to an opening in the wall of telemetry receiver 400 that is upstream from the venturi 414. The desurger 412 is coupled to another opening in the wall of telemetry receiver 400 upstream from the venturi 414 and the opening coupled to the second side of the pressure sensor 416. Pressure sensor 416 converts the detected pressure modulations to modulated electrical signals, thus producing receiver DMT signal 439. The use of a venturi type of pressure detector as shown in the detector of FIG. 4B helps to reduce distortion of the received signal caused by desurger 412; however, other pressure sensing technology may be equivalently used. FIGS. 4C through 4E illustrate alternative embodiments of the fluid modulation detector 410, each comprising a different type of pressure sensor 416. These include a bypass venturi pressure sensor (FIG. 4C), a differential pressure sensor (FIG. 4D) and a standard standpipe pressure sensor (FIG. 4E).

Figure 4F:
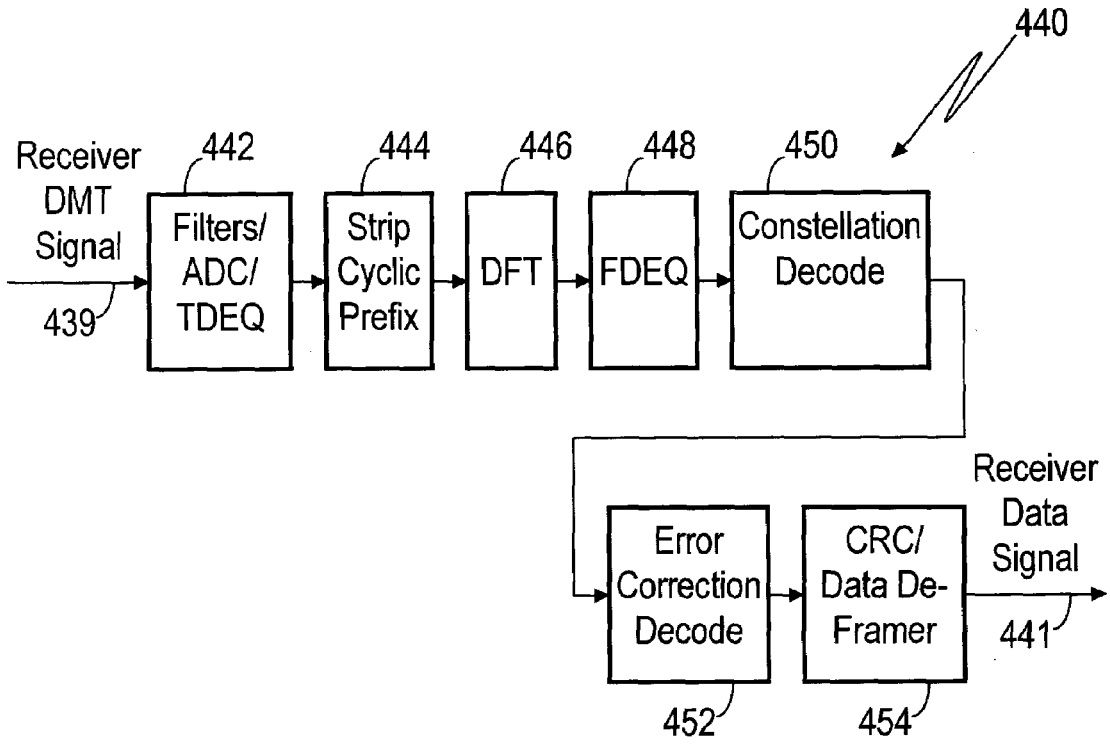
FIG. 4F illustrates a software block diagram of a DMT demodulator.

Referring again to FIG. 4A, the receiver DMT signal 439 generated by fluid modulation detector 410 may subsequently be decoded by DMT demodulator 440. As shown in FIG. 4F, DMT demodulator 440 comprises filters/analog-to-digital converter (ADC)/time-domain equalizer (TDEQ) block 442, strip cyclic prefix block 444, discrete Fourier transform (DFT) block 446, frequency-domain equalizer (FDEQ) 448, constellation decode 450, error correction decode 452, and cyclic redundancy code (CRC)/data deframer block 454. Filters/ADC/TDEQ block 442 receives and filters the receiver DMT signal 439, converts it to digital form, and performs any desired time-domain equalization of the signal. Noise cancellation may also be included in the Filters/ADC/TDEQ block 442 to filter out in-band noise. The time-domain equalization at least partially compensates for distortion introduced by propagation of the signal through the fluid, but it is likely that at least some intersymbol interference will remain.

Filters/ADC/TDEQ block 442 couples to strip cyclic prefix block 444, which processes the output signal generated by the Filters/ADC/TDEQ block 44, removing the cyclic prefixes that were added by the downhole cyclic prefix block 320 (though trailing intersymbol interference from the cyclic prefix remains in the output signal). Cyclic prefix block 444 couples to DFT block 446, which performs a Discrete Fourier Transform on the output signal from cyclic prefix block 444 to obtain the frequency coefficients. DFT block 446 couples to FDEQ block 448, which may then perform frequency-domain equalization on the output signal from DFT block 446 to compensate for the remaining intersymbol interference. It is noted that frequency-domain equalization on DFT coefficients is a cyclic convolution operation that would lead to incorrect results had the cyclic prefix not been transmitted.

FDEQ block 448 couples to constellation decode 450, which operates on the output signal of FDEQ block 448 to extract the data bits from the frequency coefficients using an inverse mapping of the downhole tone mapper 316. Constellation decode 450 couples to error correction decode 452, which decodes the data stream from constellation decode 450 and corrects such errors as are within its correcting ability. Error correction decode 452 couples to CRC/data de-framer 454, which identifies and removes synchronization information from the output signal of error correction decode 452, determining if the cyclic redundancy code indicates the presence of any errors. If error free, the recovered downhole data represented by receiver data signal 441 is ready to be processed and analyzed. Otherwise the recovered downhole data may be flagged as suspect and additional error processing may be performed by a system (not shown) coupled to telemetry receiver 400 by receiver data signal 441. The DMT demodulator 440 may be implemented in software, hardware, or a combination of the two, and the present disclosure is intended to encompass all such embodiments.

Figure 5A:
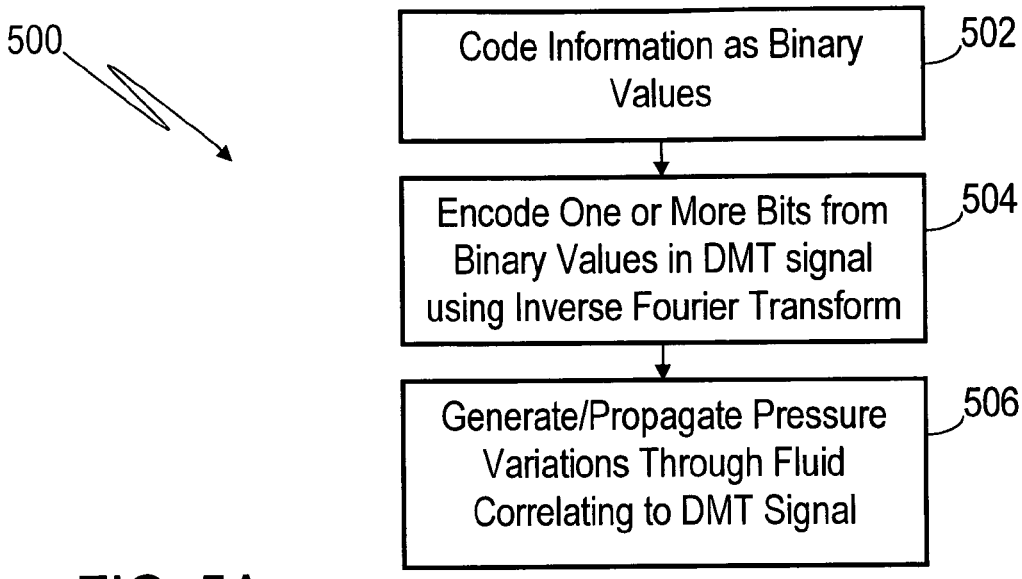
FIG. 5A illustrates a method for transmitting a DMT signal through a fluid in accordance with at least some embodiments.

FIG. 5A illustrates a method 500 for transmitting a discrete multi-tone, information-carrying signal though a fluid. Information is coded as binary values (block 502), and one or more bits of the binary values are then encoded in a discrete multi-tone signal using an inverse Fourier transform (block 504). The resulting discrete multi-tone signal is then used to generate pressure variations propagated through a fluid (block 506). The pressure variations correlate to variations in the discrete multi-tone signal, creating a discrete multi-tone signal expressed as pressure variations in a fluid.

Figure 5B:
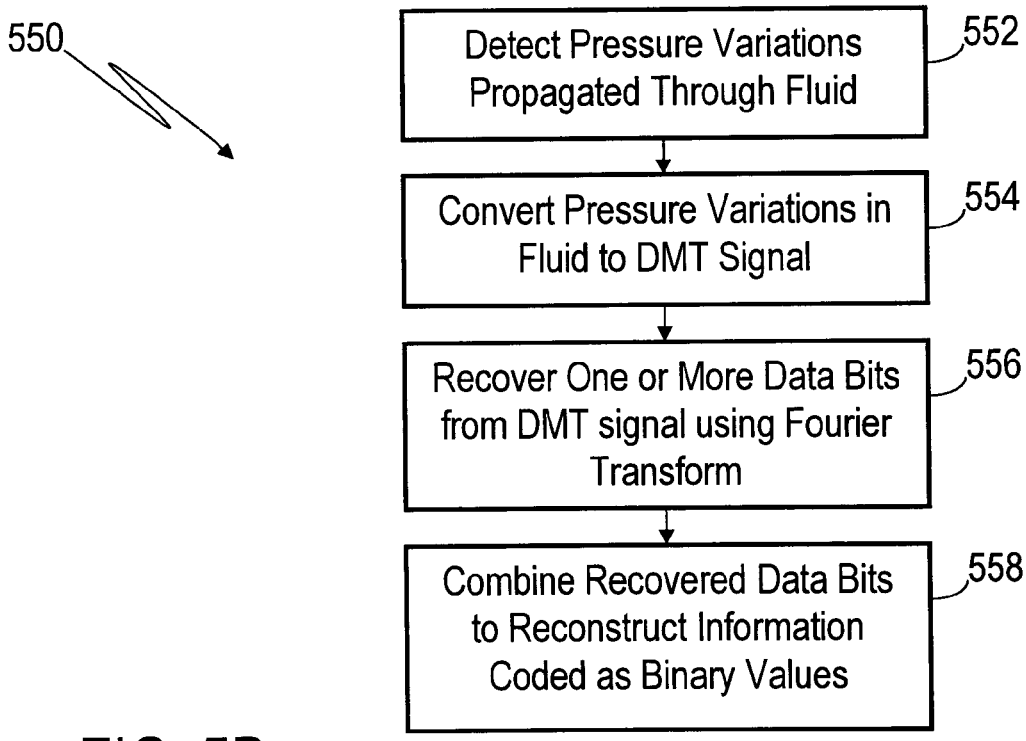
FIG. 5B illustrates a method for receiving a DMT signal through a fluid in accordance with at least some embodiments.

FIG. 5B illustrates a method 550 for receiving a discrete multi-tone, information-carrying signal transmitted though a fluid. Pressure variations propagated through a fluid are detected (block 552). The detected pressure variations are converted to a corresponding discrete multi-tone signal (block 554), and one or more data bits are recovered from the discrete multi-tone signal using a Fourier transform (block 556). These data bits are then recombined to reconstruct the coded information as binary values (block 558).

Telemetry transmissions from the telemetry transmitter 300 may comprise data sent as it is collected ("continuous" or "real-time" data), data stored and transmitted after a delay ("buffered" or "historical" data), or a combination of both. LWD data collected during actual drilling may be collected at a relatively high resolution (e.g., one sample for every six inches of penetration), and saved locally in memory (e.g., within the bottom hole assembly 28). This high-resolution data may be needed in order to perform a meaningful analysis of the downhole formations. But because of the limited bandwidth of downhole telemetry systems, the data may have to be transmitted at a much lower resolution (e.g., one sample every four feet). In at least some embodiments the data may be saved at a higher resolution as described above, and transmitted to the surface at a later time when the tool is still downhole, but while drilling is not taking place (e.g., when a tool gets stuck or when the hole is being conditioned). This historical transmission may be at a sample resolution higher than the resolution used for real-time data transmission.

When drilling is not taking place, there may be little or no real-time data being transmitted. During this time selected portions of saved data may be transmitted or retransmitted to the surface. Since this is not real-time data, the only time restriction on the transmission is the time available before drilling and real-time data transmission resume. Thus, for example, a selected, one-hour window of data saved in memory and collected at a resolution of one sample every six inches may be transmitted to the surface, even though it may take multiple hours to transmit the data.

The data may be transmitted in chronological or reverse chronological order, and may be transmitted at any resolution desired. For example, all the data may be transmitted for maximum resolution, or every other sample may be transmitted for better but not maximum resolution. The resolution selected represents a trade-off between the time available to retrieve the saved data and the resolution needed to properly analyze the data. Also, any start and stop point may be selected within the memory where the data is saved (each location in memory correlating to a measured parameter sampled at a specific drilling time and depth).

The bottom hole assembly 28 may receive commands transmitted from the surface. These commands may control the suspension of real-time data collection and/or transmission, the selection of saved data, the selection of the desired resolution of data transmission, the initiation of saved data transmission, the suspension of saved data transmission, and the resumption of real-time data collection and/or transmission.

The above disclosure is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A method, comprising:

transforming an input data series into an information-carrying signal, the information-carrying signal carrying input data from the input data series as modulations of a plurality of evenly spaced frequency bins; and applying the information-carrying signal to a transducer that converts the information-carrying signal into pressure variations within a fluid.

2. The method of claim 1, wherein transforming the input data series into the information-carrying signal comprises using an inverse Fourier transform.

3. The method of claim 1, wherein transforming the input data series into the information-carrying signal comprises generating a quadrature amplitude modulated signal.

4. A method, comprising:

detecting pressure variations propagated through a fluid;

converting detected pressure variations into an information-carrying signal; and extracting an output data series from the information-carrying signal, the information-carrying signal carrying output data from an output data series as modulations of a plurality of evenly spaced frequency bins.

5. The method of claim 4, wherein extracting the output data series from the information carrying signal comprises using a Fourier transform.

6. The method of claim 4, wherein extracting data bits from the information-carrying signal comprises demodulating a quadrature amplitude modulated signal.

7. A telemetry system, comprising:

a downhole tool comprising a sensor that generates downhole data;

a subsurface telemetry transmitter coupled to the downhole tool, the subsurface telemetry transmitter generates a first pressure-modulated signal in a fluid that comprises a plurality of evenly spaced frequency bins; and a surface telemetry receiver that detects the first pressure-modulated signal and regenerates the downhole data collected by the downhole tool;

wherein the downhole data modulates the plurality of evenly spaced frequency bins.

8. The telemetry system of claim 7, wherein the downhole data modulates the at least one of the plurality of evenly spaced frequency bins using an inverse Fourier transform.

9. The telemetry system of claim 7, wherein the downhole data is regenerated by demodulating the first pressure-modulated signal using a Fourier transform.

10. The telemetry system of claim 7, wherein the first pressure-modulated signal comprises a quadrature amplitude modulated signal.

11. The telemetry system of claim 7, further comprising:

a surface telemetry transmitter; and a subsurface telemetry receiver;

wherein the subsurface receiver is configured to receive a second pressure-modulated signal transmitted by the surface transmitter, the modulated signal comprising surface data.

12. The telemetry system of claim 11, wherein the surface data comprises at least one type of data selected from the group consisting of command data, and configuration data.

13. A subsurface telemetry transmitter, comprising:

a fluid modulation valve; and servo control logic coupled to the fluid modulation valve, the servo control logic causes the fluid modulation valve to generate discrete multi-tone (DMT) modulated pressure waves in a fluid;

wherein collected subsurface data modulates an information-carrying signal using DMT modulation; and wherein the information-carrying signal is used by the servo control logic to actuate the fluid modulation valve.

14. The subsurface telemetry transmitter of claim 13, wherein the DMT modulated pressure waves generated by the fluid modulation valve comprise a pressure variation of a discrete level, the discrete level selected from a plurality of discrete levels that can be generated by the fluid modulation valve.

15. The subsurface telemetry transmitter of claim 13, wherein the DMT modulated pressure waves generated by the fluid modulation valve comprise a pressure variation of a discrete level, the discrete level selected from a continuous range of levels that can be generated by the fluid modulation valve.

16. The subsurface telemetry transmitter of claim 13, wherein the fluid modulation valve comprises at least one valve selected from a group consisting of a hydraulically actuated valve, a magnetostrictive actuated valve, and a piezoelectric actuated valve.

17. The subsurface telemetry transmitter of claim 13, further comprising a subsurface pressure sensor coupled to the servo control logic, the pressure variations measured by the pressure sensor used by the servo control logic for feedback control of the fluid modulation valve.

18. The subsurface telemetry transmitter of claim 13, wherein the position of a moveable member within the fluid modulation valve is detected using a linear variable differential transformer (LVDT) coupled to the fluid modulation valve and the servo control logic; and wherein the position measured by the LVDT is used by the servo control logic for feedback control of the multi-level fluid modulation valve.

19. The subsurface telemetry transmitter of claim 13, further comprising a subsurface telemetry receiver that receives surface data from a surface transmitter, the surface data comprising at least one type of data selected from the group consisting of command data, and configuration data.

20. A surface telemetry receiver, comprising:

a pressure sensor that generates an information-carrying signal; and sensor signal processing logic coupled to the pressure sensor;

wherein variations in the information-carrying signal correspond to pressure variations in a fluid that are detected by the pressure sensor; and wherein the sensor signal processing logic demodulates the information-carrying signal using discrete multi-tone (DMT) demodulation and recovers subsurface data encoded in the information-carrying signal.

21. The surface telemetry receiver of claim 20, wherein the pressure sensor comprises at least one sensor selected from a group consisting of a standard standpipe pressure sensor, an inline venturi pressure sensor, a bypass venturi pressure sensor, and a differential pressure sensor.

22. The surface telemetry receiver of claim 20, further comprising a surface telemetry transmitter that transmits surface data to a subsurface receiver, the surface data comprising at least one type of data selected from the group consisting of command data and configuration data.

23. A bottom hole assembly, comprising:

a downhole tool comprising a downhole sensor that generates downhole data; and a mud modulator coupled to the downhole tool and configured to couple to a drillstring;

wherein the mud modulator generates a discrete multi-tone (DMT) modulated pressure signal propagated in drilling fluid within the drillstring, the DMT modulated pressure signal comprising the downhole data.

24. The bottom hole assembly of claim 23, wherein the DMT modulated pressure signal generated by the mud modulator comprises a pressure variation, the magnitude of the pressure variation selected from a plurality of discrete pressure variation magnitudes that can be generated by the mud modulator.

25. The bottom hole assembly of claim 23, wherein the DMT modulated pressure signal generated by the mud modulator comprises a pressure variation, the magnitude of the pressure variation selected from a continuous range of pressure variation magnitudes that can be generated by the mud modulator.

26. The bottom hole assembly of claim 23, wherein the mud modulator comprises at least one valve selected from a group consisting of a hydraulically actuated valve, a magnetostrictive actuated valve, and a piezoelectric actuated valve.

27. The bottom hole assembly of claim 23, further comprising a closed-loop control system that uses feedback information provided by the mud modulator to control the selected pressure variation level of the mud modulator.

28. The bottom hole assembly of claim 23, further comprising a subsurface telemetry receiver that receives surface data from a surface transmitter, the surface data comprising at least one type of data selected from the group consisting of command data, and configuration data.

* * * * *